US009752517B2

(12) United States Patent
Rollinger et al.

(10) Patent No.: US 9,752,517 B2
(45) Date of Patent: Sep. 5, 2017

(54) METHOD FOR AIR/FUEL IMBALANCE DETECTION

(71) Applicant: Ford Global Technologies, LLC, Dearborn, MI (US)

(72) Inventors: John Eric Rollinger, Troy, MI (US); Robert Roy Jentz, Westland, MI (US); Michael Igor Kluzner, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 157 days.

(21) Appl. No.: 14/928,883

(22) Filed: Oct. 30, 2015

(65) Prior Publication Data

US 2017/0122227 A1 May 4, 2017

(51) Int. Cl.

| | |
|---|---|
| ***F02D 37/02*** | (2006.01) |
| ***F02M 25/08*** | (2006.01) |
| ***F02D 31/00*** | (2006.01) |
| ***F02D 35/02*** | (2006.01) |

(52) U.S. Cl.

CPC ..... *F02D 37/02* (2013.01); *F02D 31/001* (2013.01); *F02D 35/02* (2013.01); *F02M 25/0827* (2013.01)

(58) Field of Classification Search

CPC ..... F02D 37/02; F02D 35/02; F02D 31/001; F02M 25/08; F02M 25/0827

See application file for complete search history.

(56) References Cited

U.S. PATENT DOCUMENTS

| | | | | |
|---|---|---|---|---|
| 5,515,826 | A * | 5/1996 | Hamburg | F02D 41/2458 123/406.47 |
| 5,690,072 | A * | 11/1997 | Meyer | F02D 41/1405 123/436 |
| 7,802,563 | B2 | 9/2010 | Behr et al. | |
| 7,900,615 | B2 | 3/2011 | Wang et al. | |
| 2013/0184969 | A1 | 7/2013 | Rollinger et al. | |

OTHER PUBLICATIONS

"Engine Tuning Principles and Guidelines," Daytona Sensors LLC, http://www.daytona-sensors.com/tech_tuning.html, pp. 1-10, Accessed Jan. 19, 2016.

* cited by examiner

*Primary Examiner* — Hieu T Vo

(74) *Attorney, Agent, or Firm* — Julia Voutyras; McCoy Russell LLP

(57) ABSTRACT

Methods and systems are described for monitoring air/fuel imbalance in cylinders of an engine. In one example method, air/fuel ratio of a cylinder is modulated to produce a series of rich, lean, and stoichiometric conditions in the cylinder and corresponding crank accelerations are measured to calculate a peak function indicating an air/fuel ratio in the cylinder. The peak function is calculated over a plurality of modulations to provide a more reliable computation of the air/fuel ratio of the cylinder and its deviation from a predetermined air/fuel ratio.

20 Claims, 8 Drawing Sheets

350

| | 330 | 332 | 334 | 336 |
|---|---|---|---|---|
| cylinder 1 | 0.94 | 0.97 | 1.04 | 1.07 |
| cylinder 2 | 1.04 | 1.07 | 1.04 | 0.97 |
| cylinder 3 | 1.04 | 0.97 | 0.94 | 0.97 |
| cylinder 4 | 0.94 | 0.97 | 1.04 | 1.07 |
| cylinder 5 | 1.04 | 1.07 | 1.04 | 0.97 |
| cylinder 6 | 1.04 | 0.97 | 0.94 | 0.97 |

METHOD FOR AIR/FUEL IMBALANCE DETECTION

FIELD

The present description relates generally to methods and systems for monitoring air/fuel imbalance of a cylinder based on crankshaft accelerations.

BACKGROUND/SUMMARY

Cylinder-to-cylinder variations in combustion associated with air/fuel ratio imbalances may occur in engines due to various factors. For example, cylinder-to-cylinder air/fuel ratio imbalances may occur due to cylinder-to-cylinder variation in intake valve depositions, plugged exhaust gas recirculation (EGR) orifices, electrical faults, air leaks, and/or shifted fuel injectors, etc. When an air/fuel ratio imbalance occurs in one or more cylinders, an engine may not be able to maintain emissions compliance.

One example approach to monitor air/fuel imbalance is shown by Rollinger et al. in U.S. 2013/0184969. Therein, a series of rich, lean, and stoichiometric conditions are generated in a cylinder by varying air/fuel ratio according to a pre-determined pattern. Crank accelerations generated due to the variations in air/fuel ratio are then measured to determine a potential air/fuel imbalance in the cylinder. Specifically, measured crank accelerations are fit to a curve and then compared to an ideal torque curve. As such, air/fuel imbalance in the cylinder is based on a slope and/or shape of the curve fit to data corresponding to air/fuel ratio and crank accelerations.

However, the inventors herein have recognized potential issues with such systems. As an example, air/fuel imbalance calculations using the method of U.S. 2013/0184969 may be distorted due to noise. In one example, when a vehicle operator activates an air conditioner, fluctuations may occur in the measured crank accelerations which may be incorrectly detected as an air/fuel ratio imbalance. In another example, operating the windows of the vehicle or activating the vehicle's lights may also affect measured crank accelerations resulting in erroneous identification of air/fuel ratio imbalances.

The inventors herein have recognized the above issues and identified an approach to at least partly address the above issues. In one example approach, a method comprises modulating an air/fuel ratio in a cylinder of an engine to generate a series of rich, lean, and stoichiometric conditions and identifying potential air/fuel imbalance in the cylinder based on a peak function, the peak function determined over a plurality of modulations of the air/fuel ratio, wherein the peak function is computed as a reciprocal of a sum of squares of crank accelerations during each of the plurality of modulations. In this way, variations occurring in crankshaft acceleration due to noise may be reduced.

In another example, a method comprises modulating an air/fuel ratio in a cylinder to produce a series of lean, rich, and stoichiometric conditions of the cylinder, identifying a potential air/fuel imbalance in the cylinder based on crank accelerations generated during the modulating, and responsive to a purge operation in the engine, disabling the modulating and ceasing the identifying of the potential air/fuel imbalance. In this way, the cylinder air/fuel imbalance monitor may be adapted to disturbances due to purge operation.

For example, a cylinder of an engine may be tested for potential air/fuel ratio imbalance by modulating air/fuel ratio in the cylinder. As such, a controller coupled to the engine may vary an amount of fuel injected into the cylinder to generate a series of lean, rich, and stoichiometric conditions in the cylinder. Further, crank accelerations during each modulation may be measured and a peak function may be estimated based on the measured crank accelerations and pre-determined crank accelerations. Furthermore, a peak function may be estimated over a plurality of modulations of air/fuel ratio. Specifically, the peak function may be calculated as a reciprocal of sum of squares of crankshaft accelerations, wherein the sum of squares of crank accelerations may include calculating a summation of differences between a pre-determined crank acceleration and a measured crank acceleration at each of the plurality of modulations added to a difference between an average pre-determined crank acceleration and an average of measured crank acceleration during the plurality of modulations. A cylinder air/fuel ratio may then be learned from the peak function. Additionally, the peak function may also indicate a deviation of the air/fuel ratio of the cylinder from a predetermined air/fuel ratio. Further still, the air/fuel imbalance estimation may be temporarily suspended if a canister purge operation is indicated. Herein, the modulation of air/fuel ratio in the cylinder of the engine and calculation of the peak functions may be temporarily suspended as purge vapors are drawn into the engine for combustion.

In this way, cylinder-to-cylinder variations in air/fuel ratio may be monitored. A technical effect of learning air/fuel ratio by conducting a plurality of air/fuel ratio modulations may be that any deviations in crank acceleration measurements caused by temporary engine loads may be reduced. Accordingly, the air/fuel ratio may be estimated based on crank accelerations with a higher accuracy. Overall, by identifying air/fuel imbalance of a cylinder with higher reliability, emissions may be reduced and engine performance may be enhanced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
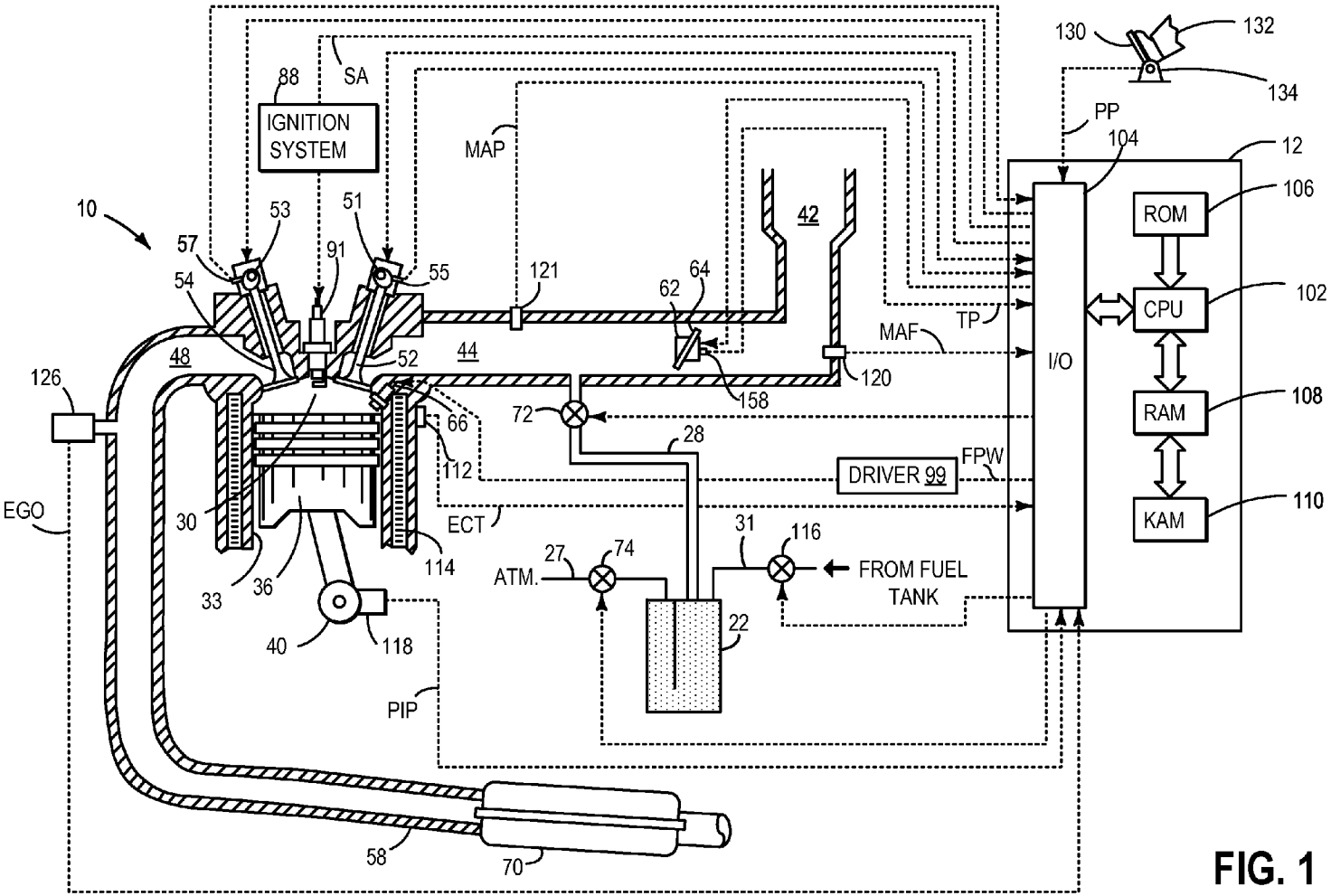
FIG. 1 shows a schematic diagram of an example engine system.
Figure 2:
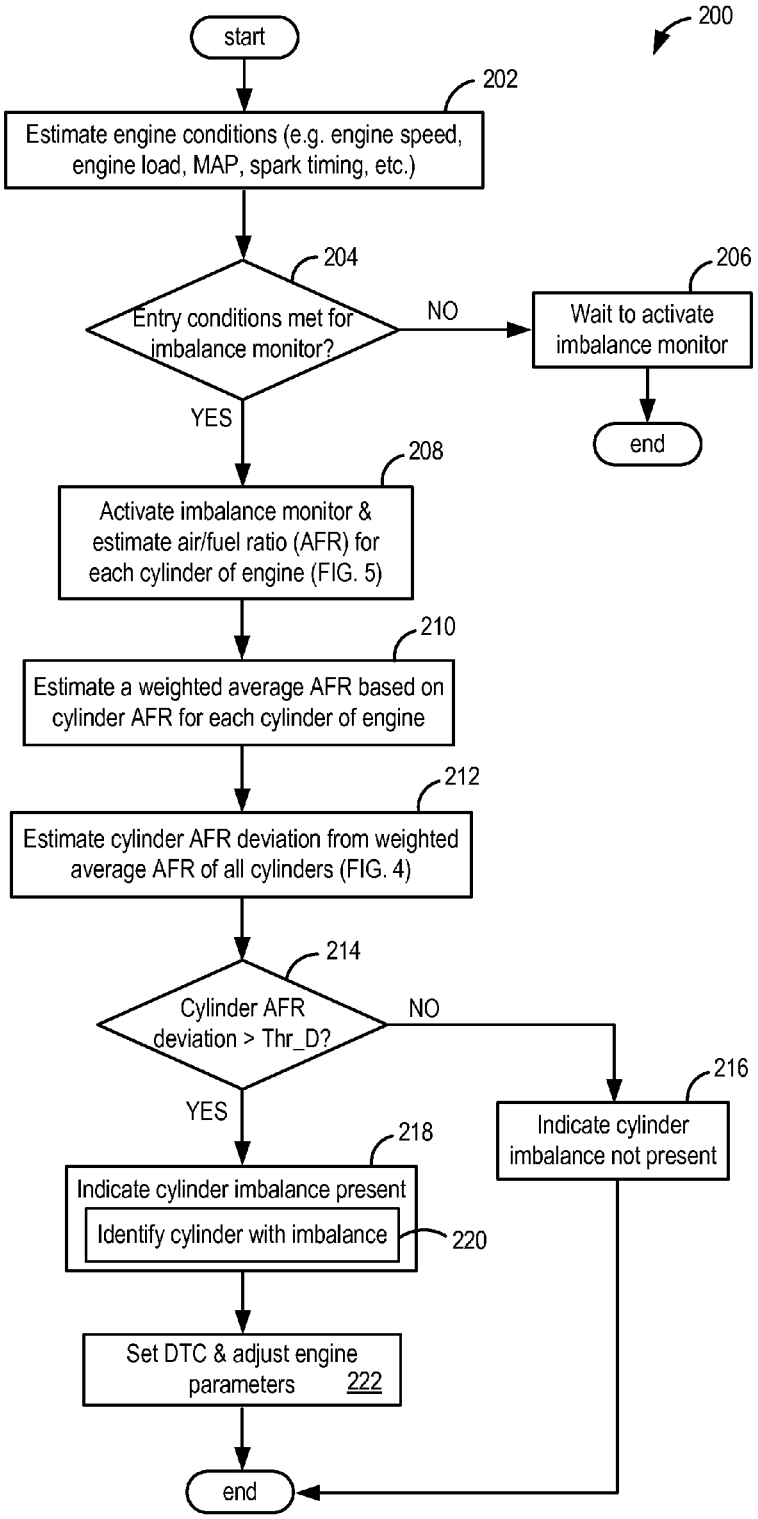
FIG. 2 presents an example flow chart illustrating a routine for determining a cylinder with air/fuel imbalance in an engine, such as the engine system of FIG. 1.
Figure 4:
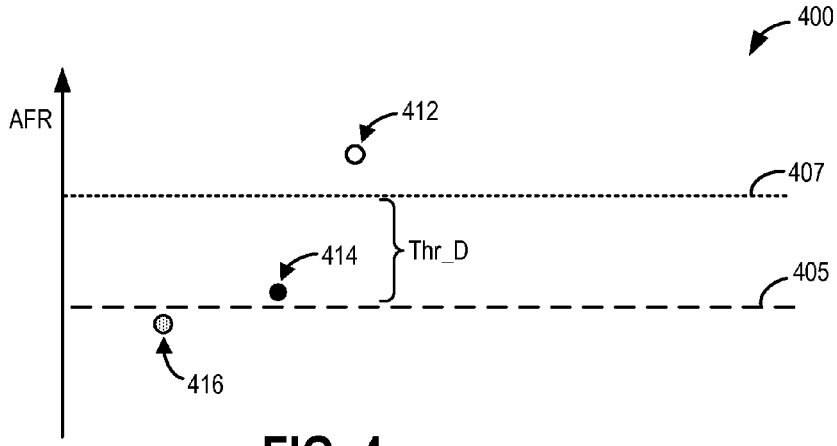
FIG. 4 portrays an example detection of a cylinder with air/fuel imbalance.
Figure 5:
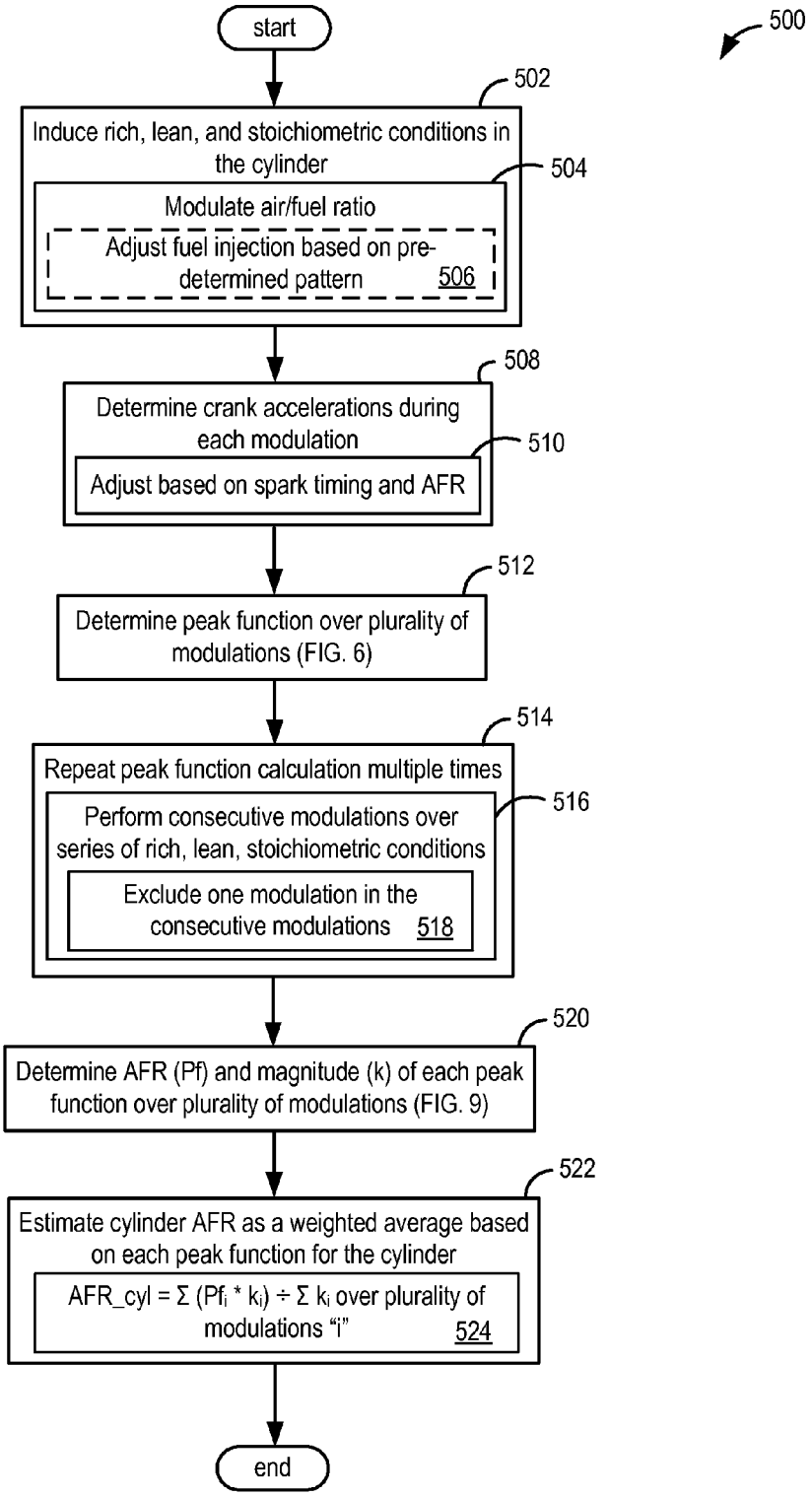
FIG. 5 shows an example flow chart illustrating a routine for estimating cylinder air/fuel ratio based on a peak function, in accordance with the present disclosure.
Figure 6:
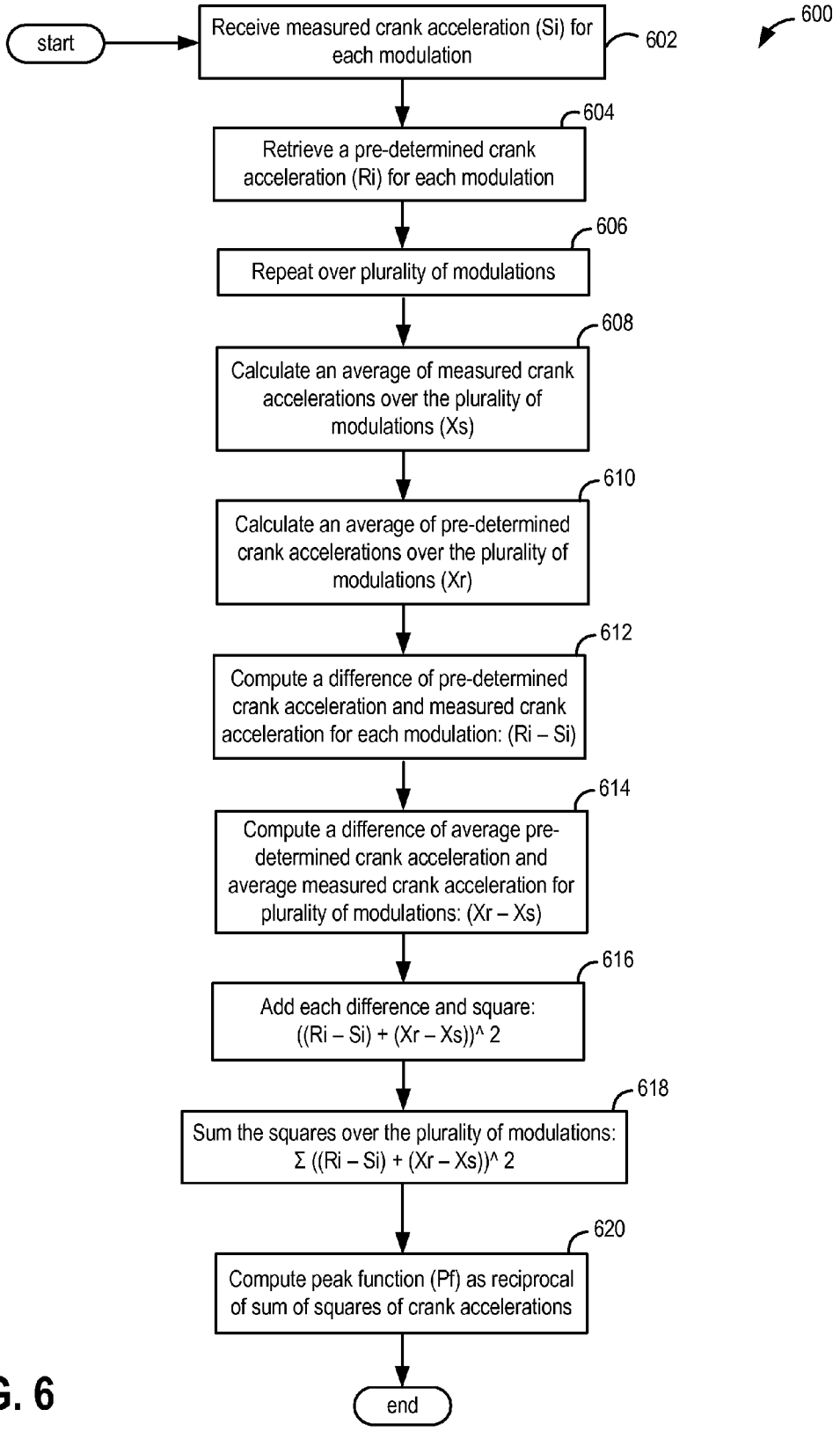
FIG. 6 is an example flow chart illustrating a routine for computing the peak function according to the present disclosure.
Figure 7:
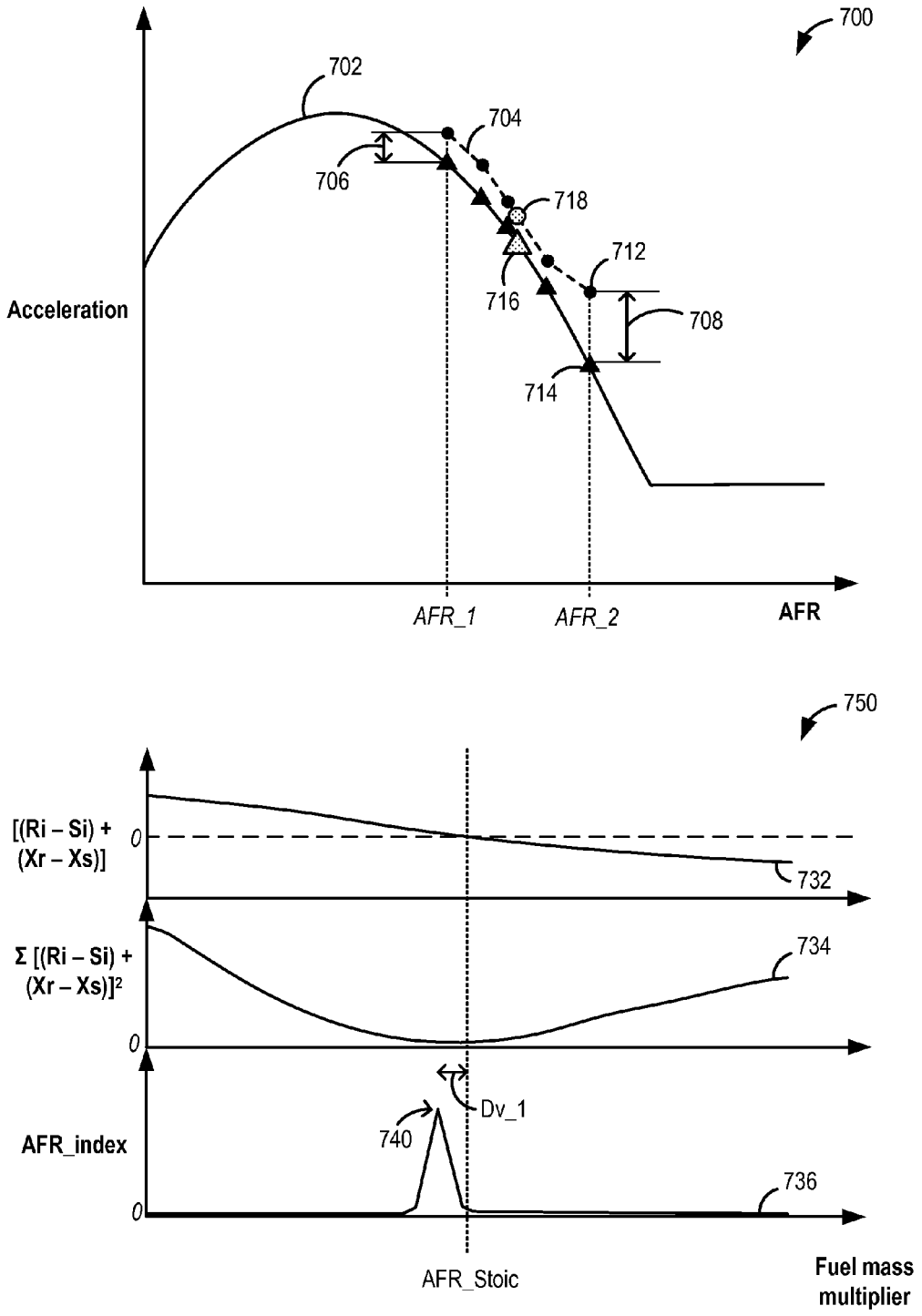
FIG. 7 portrays an example learning of peak function based on crank acceleration.
Figure 8:
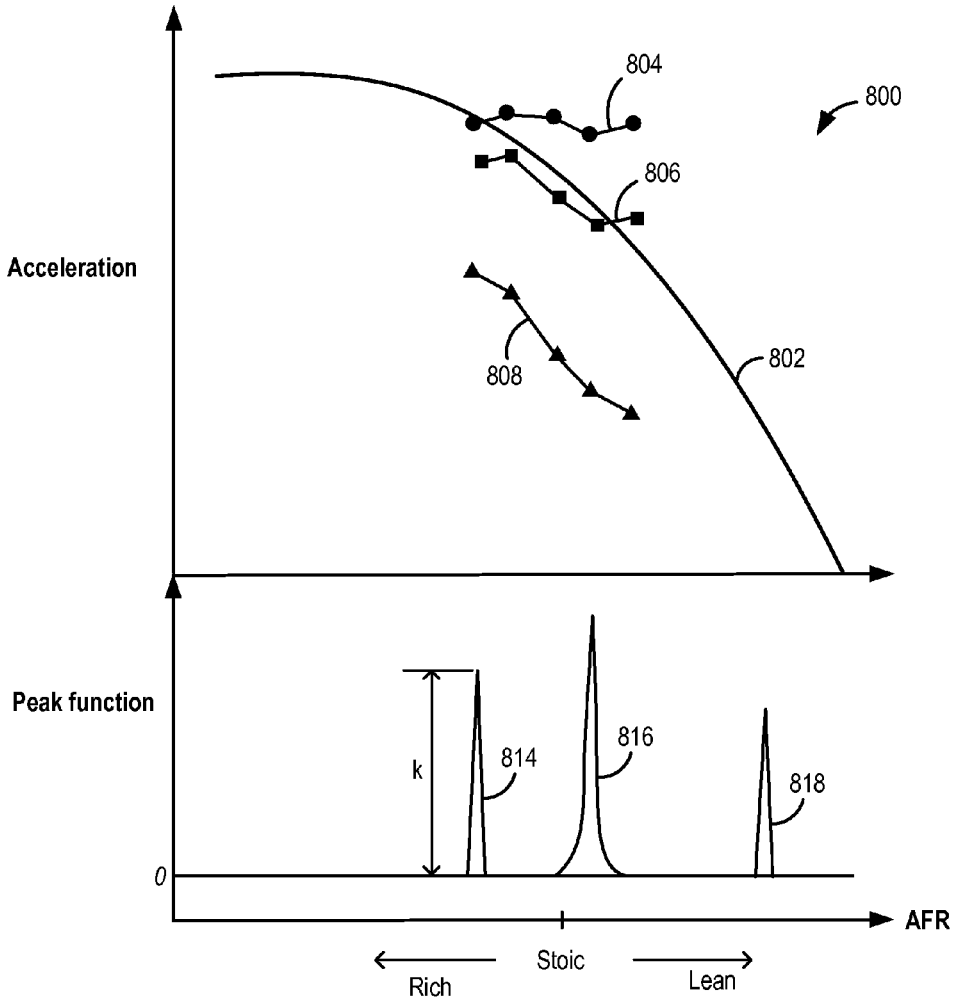
FIG. 8 presents example peak functions for different cylinders learned from crank accelerations.
Figure 9:
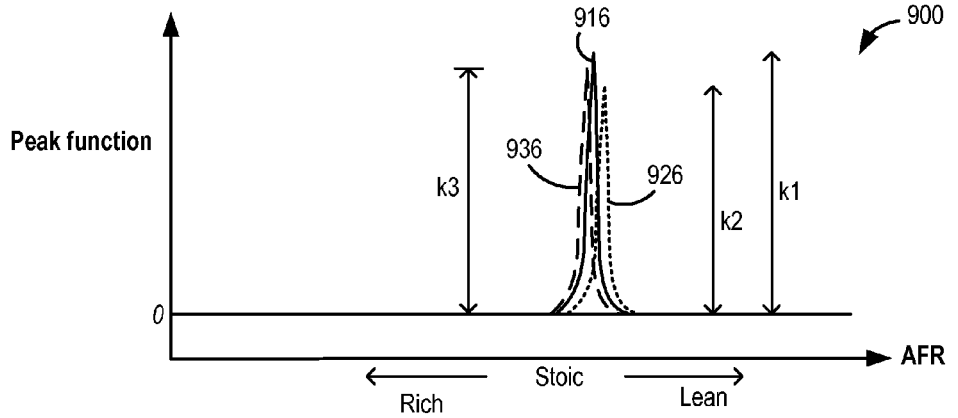
FIG. 9 depicts example peak functions for a single cylinder over a plurality of modulations.
Figure 10:
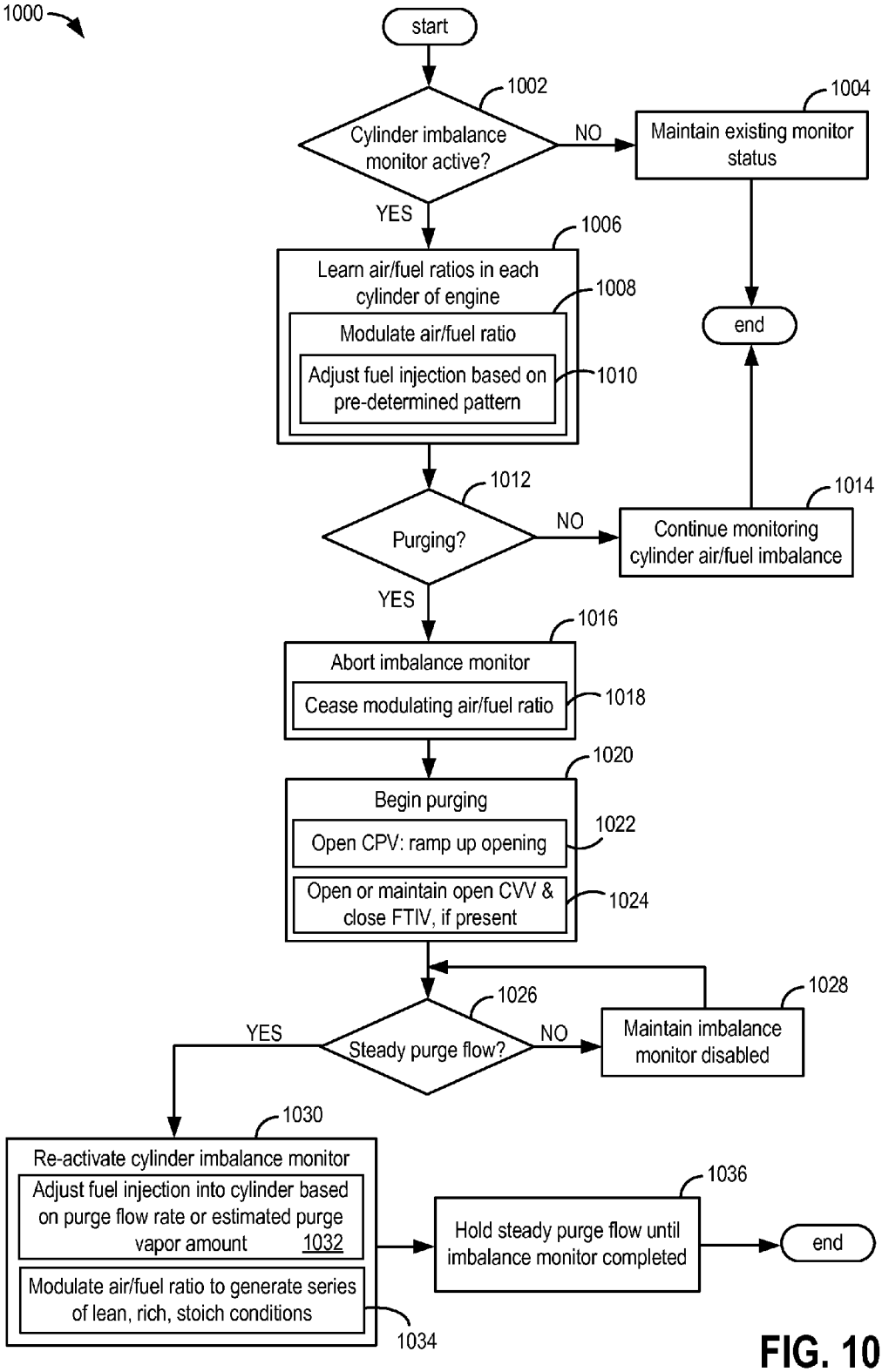
FIG. 10 presents an example flow chart with a routine for learning cylinder air/fuel ratio when a canister purge operation is initiated.

The following description relates to systems and methods for identifying potential air/fuel imbalance of cylinders in an engine, such as the engine of FIG. 1. An example air/fuel imbalance monitor may include modulating air/fuel ratio in a cylinder to generate a series of rich, lean, and stoichiometric conditions in the cylinder (FIG. 3) while maintaining the engine substantially at stoichiometry. Crank accelerations associated with the series of rich, lean, and stoichiometric conditions of the cylinder may be monitored and a peak function based on the crank accelerations may be computed (FIG. 7). The peak function may be computed as a reciprocal of a sum of squares of measured and predetermined crank accelerations over a plurality of modulations (FIG. 6). As such, the peak function may be calculated for each cylinder of the engine (FIG. 8). Further still, the peak function may be computed for each cylinder over multiple repetitions (FIG. 9) to determine a cylinder air/fuel ratio for each cylinder of the engine (FIG. 5). Additionally, the cylinder with an air/fuel ratio imbalance may be determined by calculating a deviation of the cylinder air/fuel ratio relative to a weighted average air/fuel ratio based on all cylinders of the engine (FIG. 2). The cylinder with an air/fuel ratio deviation that is higher than a threshold deviation may be indicated as the cylinder with air/fuel ratio imbalance (FIG. 4). Additionally, the modulation of air/fuel ratio and learning of peak functions may be disabled in response to a canister purge in the engine (FIG. 10). Thus, a cylinder with potential air/fuel ratio imbalance may be learned with higher accuracy while accounting for transient disturbances.

FIG. 1 shows a schematic depiction of an example cylinder 30 in internal combustion engine 10. Cylinder 30 may also be termed combustion chamber 30, herein. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP.

Combustion chamber 30 of engine 10 may include combustion chamber walls 33 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system (not shown). Further, a starter motor may be coupled to crankshaft 40 via a flywheel (not shown) to enable a starting operation of engine 10.

Combustion chamber 30 may receive intake air from intake manifold 44 via intake passage 42 and may exhaust combustion gases via exhaust manifold 48 and exhaust passage 58. Intake manifold 44 and exhaust manifold 48 can selectively communicate with combustion chamber 30 via respective intake valve 52 and exhaust valve 54. In some embodiments, combustion chamber 30 may include two or more intake valves and/or two or more exhaust valves.

In the example of FIG. 1, intake valve 52 and exhaust valve 54 may be controlled by cam actuation via respective cam actuation systems 51 and 53. Cam actuation systems 51 and 53 may each include one or more cams mounted on one or more camshafts (not shown in FIG. 1) and may utilize one or more of cam profile switching (CPS), variable cam timing (VCT), variable valve timing (VVT) and/or variable valve lift (VVL) systems that may be operated by controller 12 to vary valve operation. The angular position of intake and exhaust camshafts may be determined by position sensors 55 and 57, respectively. In alternate embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion chamber 30 for injecting fuel directly therein in proportion to the pulse width of signal FPW received from controller 12 via electronic driver 99. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system (not shown) including a fuel tank, a fuel pump, and a fuel rail. In some embodiments, combustion chamber 30 may alternatively or additionally include a fuel injector arranged in intake manifold 44 in a configuration that provides what is known as port injection of fuel into the intake port upstream of combustion chamber 30.

Ignition system 88 can provide an ignition spark to combustion chamber 30 via spark plug 91 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Intake manifold 44 is shown communicating with throttle 62 having a throttle plate 64. In this particular example, the position of throttle plate 64 may be varied by controller 12 via a signal provided to an electric motor or actuator (not shown in FIG. 1) included with throttle 62, a configuration that is commonly referred to as electronic throttle control (ETC). Throttle position may be varied by the electric motor via a shaft. Throttle 62 may control airflow from intake passage 42 to intake manifold 44 and combustion chamber 30 (and other engine cylinders). The position of throttle plate 64 may be provided to controller 12 by throttle position signal TP from throttle position sensor 158.

Exhaust gas sensor 126 is shown coupled to exhaust manifold 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 58 downstream of exhaust gas sensor 126. Device 70 may be a three way catalyst (TWC), NOx trap, various other emission control devices, or combinations thereof.

An exhaust gas recirculation (EGR) system (not shown) may be used to route a desired portion of exhaust gas from exhaust passage 58 to intake manifold 44. Alternatively, a portion of combustion gases may be retained in the combustion chambers, as internal EGR, by controlling the timing of exhaust and intake valves.

An evaporative emissions system may be coupled to each of engine 10 and a fuel system (not shown). Evaporative emissions system includes a fuel vapor container or canister 22 which may be used to capture and store fuel vapors. Vapors generated in the fuel system (e.g. a fuel tank) may be routed to fuel vapor canister 22 via vapor recovery line 31, before being purged to the intake manifold 44. Fuel vapor canister 22 may also be termed fuel system canister or simply, canister 22 herein. Vapor recovery line 31 may include one or more valves 116 for isolating the fuel tank during certain conditions. In one example, valve 116 may be a fuel tank isolation valve (FTIV 116). In another example, valve 116 may be a vapor blocking valve (VBV).

Fuel vapor canister 22 may be filled with an appropriate adsorbent to temporarily trap fuel vapors (including vaporized hydrocarbons). In one example, the adsorbent used is activated charcoal. While a single canister 22 is shown, it will be appreciated that the evaporative emissions system may include any number of canisters.

When purging conditions are met, such as when the canister is saturated, vapors stored in fuel system canister 22 may be purged to intake manifold 44, via purge line 28 by opening canister purge valve 72 (also termed, purge valve 72). Fresh air may be drawn through vent line 27 via canister vent valve 74 into canister 22 to enable desorption of stored fuel vapors. For example, canister vent valve 74 may be a normally open valve, which may be maintained open to draw fresh air into the canister 22 via vent line 27. Canister purge valve 72 may be normally closed but may be opened during certain conditions so that vacuum from engine intake manifold 44 is provided to the fuel vapor canister for purging desorbed fuel vapors.

Flow of air between canister 22 and the atmosphere may be regulated by canister vent valve 74. Fuel tank isolation valve 116 (FTIV 116) may control venting of vapors from fuel tank into the canister 22. FTIV 116 may be positioned between the fuel tank and the fuel vapor canister within conduit 31. FTIV 116 may be a normally closed valve that when opened allows for the venting of fuel vapors from fuel tank to canister 22. Air stripped of fuel vapors may then be vented from canister 22 to atmosphere via canister vent valve 74 and vent line 27. Fuel vapors stored in canister 22 may be purged to intake manifold 44 via canister purge valve 72 at a later time.

The fuel system may be operated in a canister purging mode (e.g., after an emission control device light-off temperature has been attained and with the engine operating), wherein the controller 12 may open canister purge valve 72 and canister vent valve 74 while closing FTIV 116. Herein, the vacuum generated by the intake manifold of the operating engine may be used to draw fresh air through vent line 27 and through fuel vapor canister 22 to purge the stored fuel vapors into intake manifold 44. In this mode, the purged fuel vapors from the canister are combusted in the engine. The purging may be continued until the stored fuel vapor amount in the canister is below a load threshold.

Controller 12 is shown in FIG. 1 as a conventional microcomputer including: microprocessor unit 102, input/output ports 104, read-only memory 106, random access memory 108, keep alive memory 110, and a conventional data bus. Controller 12 commands various actuators such as canister purge valve 72, throttle plate 64, fuel injector 66, and the like. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by vehicle operator 132; a measurement of intake manifold pressure (MAP) from pressure sensor 121 coupled to intake manifold 44; a profile ignition pickup signal (PIP) from Hall effect sensor 118 (or other type) coupled to crankshaft 40; a measurement of air mass entering the engine from mass airflow sensor 120; a measurement of throttle position from sensor 158; and air/fuel ratio (AFR) from EGO sensor 126. In a preferred aspect of the present description, crankshaft sensor 118, which may be used as an engine speed sensor, may produce a predetermined number of equally spaced pulses for every revolution of the crankshaft from which engine speed (RPM) can be determined. Such pulses may be relayed to controller 12 as a profile ignition pickup signal (PIP) as mentioned above. Crankshaft sensor 118 may also be utilized to measure crankshaft accelerations (also termed, crank accelerations).

Storage medium read-only memory 106 can be programmed with computer readable data representing instructions executable by processor 106 for performing various routines not specifically listed herein. The controller 12, thus, receives signals from the various sensors of FIG. 1 and employs the various actuators of FIG. 1 to adjust engine operation based on the received signals and instructions stored on a memory of the controller. For example, adjusting canister purge valve 72 may include adjusting an actuator of the canister purge valve. As an example, controller 12 may communicate a signal to the actuator of the canister purge valve, such as a solenoid, to adjust an opening of the canister purge valve.

As described above, FIG. 1 merely shows one cylinder of a multi-cylinder engine, and that each cylinder has its own set of intake/exhaust valves, fuel injectors, spark plugs, etc. In one example, engine 10 may include four cylinders arranged in an inline manner. In another example, engine 10 may include six cylinders arranged in a V-configuration. In yet another example, engine 10 may include eight cylinders arranged in a V-configuration. Alternatively, engine 10 may include additional or fewer cylinders without departing from the scope of this disclosure.

A controller, such as controller 12, of the engine may monitor for cylinder air/fuel ratio imbalance at regular intervals to detect cylinder-to-cylinder air/fuel ratio variation. As such, imbalances of air/fuel ratio in cylinders can adversely affect engine performance and engine emissions. However, when an imbalance monitor based on crank accelerations is operational, noise and disturbances from vehicle operation (e.g. activation or deactivation of an air conditioner, windows, lights, etc.) may skew and distort crank acceleration measurements. The present disclosure mitigates distortions in air/fuel imbalance monitoring from such disturbances.

Herein, air/fuel ratio in each cylinder of the engine may be intrusively modulated and corresponding variations in crankshaft rotation, specifically, crank accelerations, may be measured. Further, the engine may be at stoichiometry even though individual cylinders of the engine may not be at stoichiometry. For example, if a first cylinder is operated at a richer air/fuel ratio, a second cylinder may be operated at a leaner air/fuel ratio to maintain engine stoichiometry. Alternative patterns of modulating cylinder air/fuel ratio may be utilized to maintain the engine at stoichiometry while operating individual cylinders at richer or leaner mixtures. Further, as an additional observation, crank accelerations (e.g., torque changes) may also be measured when individual cylinders are operating at stoichiometry. The measured crank accelerations may be compared to an ideal torque curve and a peak function indicating cylinder air/fuel ratio may be calculated based on a quality of fit of measured crank accelerations to the ideal torque curve. To enhance accuracy of the peak function and minimize distortion from noise, the calculation is performed over multiple modulations of air/fuel ratio that are repeated consecutively by excluding at least one modulation. To further improve reliability of the calculated cylinder air/fuel ratio, a weighted average of the air/fuel ratio may be estimated based on the multiple modulations and resulting peak functions. Furthermore, the controller may determine a cylinder with air/fuel imbalance in the engine by comparing each cylinder's air/fuel ratio with a weighted average air/fuel ratio of all cylinders of the engine.

Turning now to FIG. 2, it depicts an example routine 200 for detecting cylinder air/fuel ratio imbalances in an engine. Specifically, an air/fuel ratio (AFR) imbalance monitor may be activated to learn an AFR of each cylinder. Further, the learned AFR of each cylinder may be compared to a weighted average AFR of all cylinders in the engine to identify the cylinder with AFR imbalance. As such, cylinder AFR may be learned, as will be described further below, by observing variations in crank accelerations corresponding to an intrusive modulation of AFR of the cylinder.

Routine 200 will be described in relation to the system shown in FIG. 1 but it should be understood that similar routines may be used with other systems without departing from the scope of this disclosure. Instructions for carrying out routine 200 (as well as routines 500, 600 and 1000) included herein may be executed by a controller, such as controller 12 of FIG. 1, based on instructions stored on a memory of the controller and in conjunction with signals received from sensors of the engine system, such as the sensors described above with reference to FIG. 1. The controller may employ engine actuators of the engine system, such as the actuators of FIG. 1 to adjust engine operation and vehicle operation, according to the routines described below.

At 202, routine 200 estimates and/or measures existing engine operating conditions. Example engine operating conditions include engine speed (Ne), engine load, MAP, spark timing, etc. For example, the controller may receive signals from a MAP sensor, such as MAP sensor 121 of FIG. 1, and learn an existing manifold pressure.

Next, at 204, routine 200 determines if entry conditions for activating an air/fuel ratio imbalance monitor (also termed air/fuel imbalance monitor) are met. Various entry conditions for starting the air/fuel monitor may be checked at 204. In one example, entry conditions may include a background sample rate (e.g., time-based sampling) entry conditions and/or foreground sample rate (e.g., crank-angle domain based sampling) entry conditions. In another example, entry conditions may depend on global conditions such as an engine temperature (engine has to be warmed up to run the test), engine load, engine speed, etc. For example, if the engine is operating at a higher engine load, the air/fuel imbalance monitor may not be activated. As such, the air/fuel imbalance monitor includes modulating air/fuel ratio (AFR) in each cylinder of the engine which may adversely affect engine output. In yet another example, the air/fuel imbalance monitor may not be activated if transient engine conditions, such as tip-ins, tip-outs, etc. are detected. In an additional example, the monitoring of air/fuel imbalance may be scheduled to be performed at specific times or intervals, e.g., after a certain number of miles have been driven, etc.

If entry conditions are not met at 204, routine 200 continues to 206 to wait to activate the air/fuel imbalance monitor, and then ends. Specifically, the routine may be disabled and rescheduled for a later time, e.g., after a certain number of miles have been driven, after a certain period of time has passed, steady state engine conditions, etc. However, if entry conditions are met, routine 200 progresses to 208 to activate the air/fuel ratio imbalance monitor to estimate AFR in each cylinder of the engine. Herein, routine 500 of FIG. 5 may be activated to modulate AFR in each cylinder of the engine. Further, corresponding crankshaft accelerations due to the AFR modulation may be measured and utilized to calculate a peak function. Further still, the peak function may be calculated over a plurality of AFR modulations in each cylinder. The peak function may indicate the AFR of the cylinder. The estimation of cylinder AFR will be described further in reference to FIG. 5 below.

At 210, routine 200 includes estimating a weighted average AFR based on estimated air/fuel ratios of each cylinder of the engine. In other words, the weighted average may be based on cylinder AFRs for all cylinders of the engine. This weighted average based on all cylinders may be termed a weighted average AFR of the engine. In one example, the weighted average AFR for all cylinders of the engine may be calculated by considering relative differences in cylinder AFR. Specifically, a cylinder-to-cylinder deviation in AFR may be estimated and the weighted average AFR may be determined based on the relative cylinder deviations as well as individual cylinder AFRs.

An example calculation of weighted average AFR of the engine (WAA_E) is depicted below for a 3-cylinder engine:

$$WAA_E=[(AFR_\text{Cyl}_1*D2)+(AFR_\text{Cyl}_2*D3)+(AFR_\text{Cyl}_3*D1)]+D_\text{total}$$

where,

AFR_Cyl_1, AFR_Cyl_2, and AFR_Cyl_3 are estimated AFRs for a first cylinder (Cyl_1), a second cylinder (Cyl_2), and a third cylinder (Cyl_3) respectively;

$D1=0.001+(\text{AFR_Cyl_1}-\text{AFR_Cyl_2})^2$;

$D2=0.001+(\text{AFR_Cyl_2}-\text{AFR_Cyl_3})^2$;

$D3=0.001+(\text{AFR_Cyl_3}-\text{AFR_Cyl_1})^2$; and $D_\text{total}=D1+D2+D3$

It will be appreciated that though the above example if for a 3-cylinder engine, the engine may include additional or fewer cylinders. Further still, if the engine is a V-type engine, a weighted average AFR for each bank of the V-engine may be calculated as above.

Next, at 212, routine 200 estimates a deviation of each cylinder AFR from the weighted average AFR based on cylinder AFRs for all cylinders of the engine. Specifically, the estimated AFR for each cylinder may be compared to the weighted average AFR of the engine. Thus, routine 200 may determine if cylinder AFRs for the cylinders of the engine are clustered together around a similar AFR or if at least one cylinder differs from the remaining cylinders by a considerable level (e.g. as an "outlier").

Referring to FIG. 4, it illustrates an example "outlier" cylinder AFR relative to a weighted average AFR of all cylinders of the engine. FIG. 4 includes map 400 depicting AFR in each cylinder of a 3-cylinder engine relative to line 405 representing the weighted average AFR of all cylinders of the 3-cylinder engine. Alternatively, the weighted average AFR represented by line 405 may be a weighted average AFR for a single bank of 3 cylinders in a 6 cylinder V-type engine.

The AFR of a first cylinder is indicated by data point 416 (dotted circle), the AFR of a second cylinder is indicated by data point 414 (solid black circle), and the AFR of a third cylinder is indicated by data point 412 (hollow circle). As shown in map 400, the AFRs of each of the first cylinder and the second cylinder (points 414 and 416) have considerably smaller deviations from the weighted average AFR of the engine (line 405). However, the AFR of the third cylinder (point 412) is at a higher deviation from the weighted average AFR of the engine. Specifically, the AFR of the third cylinder is higher than a threshold deviation, represented by line 407 (shown as Thr_D). In other words, the first cylinder and the second cylinder have AFRs that are similar to each other while the third cylinder has an AFR that is significantly different from the AFRs of each of the second cylinder and the first cylinder. Thus, the third cylinder may be considered an outlier cylinder and may be the cylinder with an air/fuel ratio imbalance.

At 214, routine 200 determines if the estimated cylinder AFR deviation from the weighted average AFR for all cylinders of the engine is greater (or higher) than a threshold deviation, Thr_D. Specifically, AFR for each cylinder may be compared to the weighted average AFR (based on all cylinder AFRs for all cylinders). Map 400 of FIG. 4 depicts an example threshold deviation as Thr_D. In one example, the threshold deviation may be expressed as a percentage deviation, such as 40%. Thus, if a cylinder AFR differs from the weighted average AFR of all cylinders of the engine (or bank) by at least 40%, the cylinder may have an air/fuel imbalance. In another example, the threshold deviation may be lower, such as at 30%. Alternative threshold deviations may be contemplated without departing from the scope of this disclosure.

Returning to routine 200, if the cylinder AFR deviation is not higher than the threshold deviation, such as in the cases of the first cylinder and the second cylinder of map 400, routine 400 continues to 216. At 216, routine 200 indicates that cylinder imbalance is not present. Herein, each cylinder of the engine may be operating at an AFR that is substantially at or close to the weighted average AFR (line 405 of FIG. 4). On the other hand, if a cylinder AFR is determined to be at a deviation greater than the threshold deviation, routine 200 progresses to 218 to indicate that cylinder imbalance is present in the engine. Herein, an outlier cylinder may be determined as shown in FIG. 4 wherein the third cylinder (data point 412) with an AFR deviation higher than the threshold deviation may have an AFR imbalance. At 220, the cylinder with AFR imbalance is identified. Further, at 222 routine 300 sets a diagnostic trouble code (DTC) in a memory of the controller indicating the cylinder imbalance. Setting the DTC may also include illuminating a malfunction indicator lamp (MIL) to indicate the cylinder air/fuel imbalance. Further still, at 222 routine 200 includes adjusting engine parameters. In one example, a spark timing may be adjusted based on the learned imbalance. In another example, fuel injection to the affected cylinder may be adjusted based on the AFR imbalance in the cylinder. Routine 200 then ends.

Thus, a first air/fuel ratio of a first cylinder of an engine may be learned by modulating air/fuel ratio in the first cylinder and observing corresponding crank accelerations. Similarly, a second air/fuel ratio of a second cylinder of the engine may also be learned by varying AFR in the second cylinder and observing associated changes in the crank accelerations. Further, a weighted average of air/fuel ratio may be calculated based on learned air/fuel ratios for each of the first cylinder and second cylinder. Further still, degradation of the first cylinder may be indicated responsive to a deviation of the first air/fuel ratio from the weighted average being higher than a threshold deviation, Thr_D of FIGS. 2 and 4. Furthermore, the second cylinder may not be degraded if a deviation of the second air/fuel ratio from the weighted average is lower than the threshold deviation.

Turning now to FIG. 5, it presents an example routine 500 for estimating air/fuel ratios in each cylinder of an engine, such as engine 10. Herein, air/fuel ratios in each cylinder may be intrusively modulated over a range of rich, lean, and stoichiometric conditions, and resulting crank accelerations may be measured and utilized to determine a peak function which indicates an air/fuel ratio in the cylinder as well as a deviation of the cylinder air/fuel ratio from a pre-determined air/fuel ratio. The cylinder air/fuel ratio may be learned with higher accuracy by repeating the plurality of air/fuel ratio modulations repetitively and by discarding one or more modulations in each measurement. These calculations will be described in further detail below. Routine 500 will be described in reference to the engine system of FIG. 1.

At 502, routine 500 includes inducing a series of rich, lean, and stoichiometric conditions in a cylinder of an engine, such as engine 10 of FIG. 1. As such, each cylinder's AFR may be learned by inducing the series of rich, lean, and stoichiometric conditions. The rich, lean, and stoichiometric conditions may be induced by modulating an air/fuel ratio in each cylinder, at 504. For example, an amount of fuel injected into the cylinder may be varied. As such, at 506, the amount of fuel injection may be varied based on a pre-determined pattern. Alternatively, random air/fuel ratio variations occurring due to engine operation may also be utilized. In an additional example, an amount of air flow into the cylinder may also be adjusted to modulate air/fuel ratio.

Figure 3:
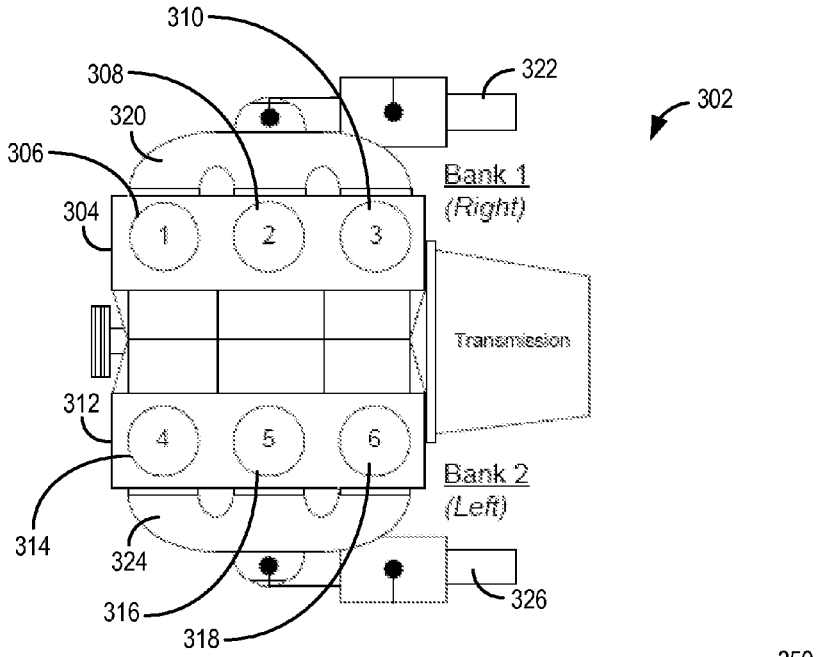
FIG. 3 depicts an example series of rich, lean, and stoichiometric conditions used to induce crank accelerations.

FIG. 3 shows an example series of rich, lean, and stoichiometric conditions used to induce crank accelerations of an example V-6 engine 302. Engine 302 includes a first bank 304 (Bank 1) of cylinders including cylinder 306 (cylinder 1), cylinder 308 (cylinder 2), and cylinder 310 (cylinder 3). Engine 302 also includes a second bank 312 (Bank 2) of cylinders including cylinder 314 (cylinder 4), cylinder 316 (cylinder 5), and cylinder 318 (cylinder 6). Intake manifold 320 and exhaust manifold 322 are coupled to the cylinders in bank 304. Intake manifold 324 and exhaust manifold 326 are coupled to the cylinders in bank 312.

Example patterns used to generate a series of rich, lean, and stoichiometric conditions in the engine cylinders are shown in table 350. In table 350, four example sets of patterns are shown in four columns where column 330 shows a first pattern set, column 332 shows a second pattern set, column 334 shows a third pattern set, and column 336 shows a fourth pattern set. Each entry in a column is a fuel mass multiplier which may be applied to stoichiometry (lambda=1). For example, in column 330 and the first pattern set, multiplier 0.94 is applied to cylinder 1 when cylinder 1 fires, multiplier 1.04 is applied to cylinder 2 when cylinder 2 fires, 1.04 is applied to cylinder 3 when cylinder 3 fires, etc. By using different fuel mass multipliers, the air/fuel ratio in each cylinder may be modulated.

These multipliers are chosen so that each bank of the engine remains substantially at stoichiometry (e.g. within 5% of stoichiometry) when applied to the cylinders in a specified firing order. For example, if cylinder 1 is fired with a richer air/fuel ratio, cylinders 2 and 3 (of the same bank) may be fired with leaner air fuel ratios to maintain bank stoichiometry and engine stoichiometry. Columns 332, 334, and 336 show additional example patterns which include fuel mass multipliers as in column 330 but with different values for different cylinders which still maintain the engine at stoichiometry when applied. It will be noted that though not shown in table 350, the air/fuel imbalance monitor may also modulate the air/fuel ratios in each cylinder at stoichiometry (or assumed stoichiometry) for additional readings. The example patterns may be applied to each cylinder consecutively while the air/fuel imbalance is being monitored.

Returning to routine 500 of FIG. 5, at 508 crank accelerations associated with each modulation of AFR in each cylinder are measured. For example, crank accelerations may be determined based on output of a crankshaft sensor, such as sensor 118 of FIG. 1. The crankshaft accelerations may be estimated during the power stroke of a firing cylinder. The crankshaft accelerations resulting from the air/fuel perturbations may be monitored and processed by controller 12, for example. As such, the crank accelerations may be processed to indicate torque changes.

Referring again to FIG. 3, for example, engine 302 may be operated with the first pattern set (shown by column 330) and associated crank accelerations may be measured. Thus, each cylinder of engine 302 may receive fuel (to modulate air/fuel ratio) based on the first pattern set. The engine 302 may be operated next with the second pattern set (column 332) and corresponding crank accelerations may be measured. Thus, the second pattern set may be applied consecutive to the first pattern set. The second pattern set may be followed by the third pattern set and so on. Thus, cylinder 1 may be fired in a first cycle with multiplier 0.94, in a second cycle following the first cycle with multiplier 0.97, in a third cycle following the second cycle with multiplier 1.04, etc. and consequent crank accelerations may be measured. It will be understood that a plurality of modulations of AFR may be induced by operating each cylinder with the various patterns shown in table 350. In another example, the engine 302 may be operated with the first pattern set of fuel mass multipliers (column 330) for multiple cycles and associated crank accelerations may be measured. After a first set of repetitions, the engine 302 may be operated with the second pattern set for multiple cycles and ensuing crank accelerations may be measured.

Thus, for each rich, lean, and stoichiometric condition generated in a cylinder, as described in FIG. 3, crankshaft accelerations and resulting torque changes corresponding to each induced condition may be monitored and stored in a memory of the controller.

Returning to routine 500, at 508 determining crankshaft accelerations may include calculating normalized torque accelerations for each crankshaft acceleration generated by each lean, rich, or stoichiometric condition induced in a cylinder. The measured crankshaft acceleration may be normalized in a variety of ways. For example, estimated crankshaft acceleration may normalized by a value of indicated torque minus an accessory load. As another example, at 510 of routine 500, crankshaft acceleration is normalized for spark timing. Specifically, crank accelerations may be normalized by compensating for spark due to induced AFR (e.g., lean and rich conditions) in the cylinder. As such, a change in laminar flame speed may occur at an induced AFR in the cylinder, wherein the induced AFR is distinct from stoichiometry. Accordingly, a correction factor may be applied for a value of deviation between spark timing at stoichiometry and spark timing at the induced AFR in the cylinder. In one example, the correction factors may be stored in look-up tables in the memory of the controller.

The normalized acceleration values and correlated air/fuel ratio values for every cylinder and for every lean, rich, and stoichiometric condition induced in the cylinders may also be stored in a memory component of controller 12 for further processing as described below.

At 512, routine 500 includes determining a peak function for a plurality of modulations of AFR for each cylinder. The peak function may be estimated by activating routine 600 of FIG. 6.

Turning now to FIG. 6, it presents example routine 600 for calculating a peak function, Pf, for a given cylinder based on a plurality of modulations of AFR in the given cylinder. Specifically, the peak function is based on a sum of squares of normalized crank accelerations data generated over a plurality of modulations of AFR in the given cylinder, as shown in table 350. For example, the peak function of cylinder 1 of FIG. 3 may be learned by modulating AFR in cylinder 1 through the sets of fuel mass multiplier patterns shown in table 350 (e.g., plurality of modulations) in a repetitive manner.

At 602, routine 600 receives measured crank acceleration data for each modulation. As described earlier, the crank accelerations may be measured for each AFR induced in the given cylinder. The measured crank accelerations may be normalized as described in reference to 510 to routine 500. Further, the measured crank accelerations are denoted as 'Si' wherein the "i" represents each iteration of measuring the crank acceleration for a correlated AFR. At 604, routine 600 retrieves a pre-determined crank acceleration, Ri, for each modulation. The pre-determined crank acceleration (or normalized torque) may be based on an ideal torque curve. Further, each Ri may be correlated to a corresponding measured crank acceleration, Si, based on the AFR.

At 606, routine 600 repeats the receiving and retrieving of measured crank accelerations and pre-determined crank accelerations, respectively, for the given cylinder over the plurality of modulations. As described earlier, the plurality of modulations may include operating the given cylinder with each of the fuel mass multiplier pattern sets shown in table 350. In another example, the plurality of modulation may include operating the given cylinder with multiple repetitions of the fuel mass multiplier pattern sets (or simply, patterns) in a consecutive manner. Next at 608, routine 600 calculates an average or mean of measured (and normalized) crank accelerations, Xs, over the plurality of modulations. Further, at 610, routine 600 also computes an average of pre-determined crank accelerations, Xr, over the plurality of modulations. Further details of Si, Ri, Xs, and Xr will be elaborated with reference to FIG. 7.

Referring to map 700 of FIG. 7, it portrays the normalized torque accelerations for the given cylinder plotted on a mapping of crankshaft accelerations (or normalized torque) versus air/fuel ratios corresponding to the series of rich, lean, and stoichiometric conditions induced in the given cylinder. Map 700 includes crank accelerations plotted along the vertical or y-axis and AFR plotted along the horizontal or x-axis. Plot 704 depicts the mapping of measured crank accelerations from the given cylinder corresponding to the series of rich, lean, and stoichiometric conditions of AFR. Plot 702 depicts an ideal torque curve.

It will be noted that while plot 704 is depicted above ideal torque curve indicated by plot 702, in other examples, the measured accelerations may be lower than the ideal torque curve (or below plot 702). As such, the measured crank accelerations may be either above or below the ideal torque curve based on a strength of the cylinder being monitored. The strength of the cylinder may be a function of geometry of the cylinder, spark timing, etc.

Plot 704 includes measured crank accelerations associated with at least 5 modulations of AFR represented by circles 712. Thus, measured crank accelerations, Si, at each of the 5 modulations of AFR are indicated by solid circles 712 along plot 704. Further, pre-determined crank accelerations, Ri, based on the ideal torque curve for the same 5 modulations of AFR (as the measured crank accelerations) may be indicated by triangles 714. Thus, at each modulation of AFR (e.g. iteration "i"), a corresponding pre-determined crank acceleration, Ri, and a corresponding measured crank acceleration, Si, may be determined based on plots 702 and 704 respectively. For example, at AFR_1, pre-determined crank acceleration may be represented by the first triangle (or triangle at extreme left) on plot 702 while measured crank acceleration may be indicated by the first circle (or circle at extreme left) on plot 704.

Further, an average, e.g. Xs, of the measured crank accelerations (e.g. Si) over the 5 modulations of AFR is represented by dotted circle 718. Thus, Xs for the 5 modulations (or iterations) of AFR may be represented by the following equation:

$$Xs=\Sigma_{i=1}^{n=5}Si/5 \quad (1)$$

Likewise, an average, Xr, of the pre-determined crank accelerations, Ri, correlating to the same 5 modulations of AFR where the crank accelerations are measured is represented by dotted triangle 716. Thus, Xr for the 5 modulations of AFR may be represented by the following equation:

$$Xr=\Sigma_{i=1}^{n=5}Ri/5 \quad (2)$$

Returning to 612 of routine 600 in FIG. 6, routine 600 computes a difference between the pre-determined crank acceleration and the measured crank acceleration at each AFR modulation. Thus, for each iteration of AFR modulation, the difference (Ri−Si) is computed. Herein, the routine 600 may determine a shift of the measured crank acceleration from the ideal torque curve, e.g. the corresponding pre-determined crank acceleration. Further, at 614, routine 600 determines a difference between the average pre-determined crank acceleration, Xr, and the average measured crank acceleration, Xs, over the plurality of modulations. With reference to map 700 of FIG. 7, example differences between pre-determined crank acceleration and measured crank acceleration for a given AFR are shown. For example, at AFR_1, (Ri−Si) is indicated by 706 while at AFR_2, the corresponding (Ri−Si) is indicated by 708. In the depicted example, (Ri−Si) at AFR_1 is smaller than (Ri−Si) at AFR_2. The difference between Ri and Si at each of the 5 AFR modulations may be calculated, though only two are shown for example. At the same time, a difference between Xr and Xs may be calculated (e.g. difference between 716 and 718 on map 700).

Returning to routine 600 of FIG. 6, at 616 for each AFR modulation (or AFR iteration), the two differences, e.g. (Ri−Si) and (Xr−Xs), are added to each other and then squared, as shown in the equation below:

$$((Ri-Si)+(Xr-Xs))\hat{}2 \quad (3)$$

As such, the difference (Xr−Xs) may remain the same for each iteration in a given calculation.

Further, at 618 the term of equation (3) above may be summed over the plurality of modulations of AFR, as shown by the equation below:

$$\Sigma_{i=1}^{n=5}((Ri-Si)+(Xr-Xs))\hat{}2 \quad (4)$$

In other words, equation 4 represents a sum of squares of crank accelerations. Thus, equation 4 includes a difference between pre-determined crank acceleration and measured crank acceleration at each of the plurality of modulations (e.g., 5 modulations of FIG. 7) added to a difference between an average of pre-determined crank accelerations and an average of measured crank accelerations over the plurality of modulations (e.g., 5 modulations of FIG. 7). Further, the difference between pre-determined crank acceleration and measured crank acceleration at each of the plurality of modulations added to a difference between an average of pre-determined crank accelerations and an average of measured crank accelerations over the plurality of modulations is squared before calculating the summation.

Next, at 620, the peak function, Pf, for the given cylinder is calculated as a reciprocal of the sum of squares of crank accelerations over the plurality of modulations summed over multiple repetitions of the modulations of AFR, as shown by the equation below:

$$\text{Peak function } (Pf)=1/\Sigma_{j=1}^{n1}(\Sigma_{i=1}^{n=5}((Ri-Si)+(Xr-Xs))\hat{}2 \quad (5)$$

The peak function may also be termed an AFR_index. The peak function, Pf, may indicate an AFR of the given cylinder and may concurrently indicate a deviation of the AFR of the given cylinder from a pre-determined AFR. The pre-determined AFR may be the AFR induced within the cylinder. In another example, the pre-determined AFR may be stoichiometry, which may be an assumed stoichiometric ratio. Routine 600 then ends.

Turning again to FIG. 7, it includes map 750 showing the different calculations (mentioned above) enabling learning the peak function. Map 750 includes plot 732 showing a variation of ((Ri−Si)+(Xr−Xs)), plot 734 showing a variation of $[(Ri-Si)+(Xr-Xs)]^2$, and plot 736 showing the peak function. All the above plots are shown against a fuel mass multiplier or AFR.

Plot 732 may include data that is positive and negative while plot 734 shows the sum of squares approaching "zero". As such, if the measured crank accelerations are substantially comparable (e.g. within 10%) to the pre-determined crank accelerations of the ideal torque curve, the difference between the measured crank acceleration and the corresponding pre-determined crank acceleration at each AFR modulation will be negligible. In other words, if the measured crank accelerations are substantially similar to the corresponding pre-determined crank accelerations (or the ideal torque curve), the term $[(Ri-Si)+(Xr-Xs)]^2$ will be smaller and will approach zero. To emphasize the approach to minima, a reciprocal of the summation of differences squared may be calculated as shown in plot 736 allowing a peak function to be calculated. As such, the peak function is depicted at 740 and as shown, the peak function indicates a deviation, Dv_1, of the cylinder AFR from a pre-determined air/fuel ratio such as assumed stoichiometry (AFR_Stoic).

As such, the measured crank accelerations may be normalized to the ideal torque curve to learn the cylinder AFR. The AFR_index or peak function provides an idea of a quality of match between the measured crank accelerations and the corresponding pre-determined crank accelerations along the ideal torque curve at a given AFR. In the example plot 736, the peak function 740 indicates that the cylinder AFR is not at stoichiometry but leaner than a pre-determined AFR such as an assumed stoichiometry. As such, the above calculation detects the shift of the cylinder AFR from assumed stoichiometry induced within the cylinder.

FIG. 8 includes map 800 depicting example peak function calculations for multiple cylinders. Specifically, map 800 illustrates measured crank accelerations and the corresponding peak functions for 3 cylinders. As an example, the 3 cylinders may be 3 cylinders from Bank 1 of engine 302 of FIG. 3. Map 800 includes a top graph portraying acceleration (or crank acceleration) plotted against AFR. The top graph includes plot 802 depicting the ideal torque curve and example measured crank accelerations for the 3 cylinders. To elaborate, plot 804 depicts measured crank accelerations for a first cylinder, plot 806 presents measured crank accelerations for a second cylinder, and plot 808 portrays measured crank accelerations for a third cylinder. Map 800 also includes a bottom graph including the computed peak functions for each of the first, second, and third cylinders. Specifically, plot 814 is the peak function corresponding to the first cylinder (and plot 804), plot 816 is the peak function corresponding to the second cylinder (and plot 806), and plot 818 is the peak function corresponding to plot 808 for the third cylinder. Each of the top graph and the bottom graph are depicted against AFR on the x-axis. AFR may increase from left to right. In other words, AFR may vary between being leaner than stoichiometry, richer than stoichiometry, and at stoichiometry.

The magnitude or height 'k' of each peak function may vary based on a quality of fit between measured crank accelerations and pre-determined crank accelerations (e.g., the ideal torque curve). For example, a higher magnitude of the peak function may indicate a higher match between the measured crank accelerations and corresponding pre-determined crank accelerations of the ideal torque curve. Further, each peak function indicates deviation of each cylinder AFR from a pre-determined AFR, e.g. assumed stoichiometry.

As depicted in FIG. 8, the second cylinder may be operating at an AFR that is closest to stoichiometry. In other words, plot 816 showing the peak function for the second cylinder is situated substantially closer to the pre-determined stoichiometry point along the x-axis. Further, the magnitude of the peak of plot 816 is higher indicating that plot 806 may be substantially similarly shaped as the ideal torque curve. In other words, measured crank accelerations due to AFR modulations in the second cylinder may be considerably similar to pre-determined crank accelerations. On the other hand, plot 818 showing the peak function for the third cylinder based on plot 808 indicates that the third cylinder is operating at significantly leaner than assumed stoichiometry. Further, the magnitude of the peak of plot 818 is lower than that of plot 816 indicating that measured crank accelerations corresponding to AFR modulations in the third cylinder may not match the pre-determined crank accelerations. As such, measured crank accelerations for the third cylinder may be significantly different from the pre-determined crank accelerations.

The first cylinder, unlike the second and third cylinders, may be operating at richer than assumed stoichiometry as shown by plot 814. Further, the magnitude of the peak function of plot 814 may be higher than that of plot 818 but smaller than that of plot 816. Accordingly, the measured crank accelerations corresponding to AFR modulations in the first cylinder may not fit the ideal torque curve as well as the measured crank accelerations of the second cylinder.

To enhance the accuracy of the determination of the peak function, additional calculations may be performed which will be further detailed in reference to routine 500 of FIG. 5.

Returning now to 512 of routine 500, once the peak function is learned for the plurality of modulations (and repetitions) in the given cylinder, accuracy of the peak function and cylinder AFR analysis may be enhanced by performing additional modulations. At 514, routine 500 includes repeating the calculation of the peak function multiple times. As such, the AFR of each cylinder may be modulated repeatedly according to the patterns shown in table 350. In other words, routine 500 performs consecutive modulations of AFR in the cylinder over the series of rich, lean, stoichiometric conditions in accordance with the pre-determined patterns.

To further increase the accuracy of cylinder AFR assessment, routine 500 also excludes at least one modulation in the consecutive repetitive modulations of AFR at 518. To elaborate, in one example, with reference to table 350 of FIG. 3, cylinder 1 may initially undergo sequential intrusive modulations of AFR as follows: pattern in column 330, pattern in column 332, pattern in column 334, pattern in column 336, and back to pattern in column 330, pattern in column 332, etc. to determine an initial peak function. To enhance the accuracy of the peak function, additional calculations may be performed by modulating the AFR in cylinder 1 as follows: pattern in column 330, pattern in column 332, pattern in column 336, pattern in column 330, pattern in column 334, pattern in column 336, pattern in column 332, pattern in column 334, etc. Herein, every third pattern may be excluded. For example, pattern in column 334 may be skipped in the sequence of modulations from pattern in column 330, pattern in column 332, to pattern in column 336. Alternative examples of AFR imbalance monitoring may include added AFR modulation patterns and may exclude one modulation in a different manner. For example, if the air/fuel imbalance monitor includes 7 patterns of AFR modulation in the engine cylinders, to enhance accuracy of learning the peak function, every fifth pattern may be excluded. In yet another example, instead of excluding a single modulation, two modulations may be excluded in the consecutive repetition of the pattern modulations.

At 520, routine 500 calculates a peak function (Pf) and magnitude of each peak function (k) for each iteration, i, of the modulations in the cylinder. Referring to FIG. 9, it presents an example map 900 illustrating a plurality of peak functions calculated for a specific cylinder by excluding one modulation of AFR over consecutive AFR modulations. Map 900 depicts peak function on the y-axis and AFR along the x-axis. The AFR varies between richer than stoichiometry, leaner than stoichiometry, and stoichiometry.

Map 900 also includes plot 916 indicating a first peak function for a cylinder with magnitude k1, plot 926 for a second peak function for the cylinder (e.g., the same cylinder) with magnitude k2, and plot 936 showing a third peak function for the same cylinder with magnitude k3. Herein, each of the first peak function, the second peak function, and the third peak function indicate an AFR for the same cylinder.

As depicted, each of the peak functions also indicates that cylinder AFR is slightly leaner than stoichiometric. In other words, each peak function indicates cylinder AFR deviation from a pre-determined AFR, such as stoichiometry. It will be noted that stoichiometry as represented on the x-axis may be an assumed stoichiometry. As mentioned earlier in the description, the magnitude of the peak function may indicate a quality of match between measured crank accelerations and corresponding pre-determined crank accelerations (of the ideal torque curve). The AFR of the cylinder may be more accurately determined based on the three peak functions shown in map 900. Specifically, the AFR of the cylinder may be calculated as a weighted average AFR based on each of the three peak functions for the cylinder shown in map 900. Each peak function may be weighted based on its respective magnitude. Thus, the peak function with a higher magnitude and therefore, a higher match between measured crank accelerations and corresponding pre-determined crank accelerations, receives a greater weight in the calculation of cylinder AFR.

Returning to routine 500 at 522, cylinder AFR is estimated as a weighted average based on each peak function determined for the cylinder during the consecutive repetition of modulations with at least one modulation excluded. Specifically, at 524, the cylinder AFR (AFR_cyl) is calculated as follows:

$$\frac{\sum (Pf_i * k_i)}{\sum k_i} \tag{6}$$

where, $Pf_i$ is a peak function for each iteration of the AFR modulation with one modulation excluded, and $k_i$ is the magnitude corresponding to the peak function. Routine 500 then ends.

Referring to FIG. 9 and map 900, with three peak functions for the same cylinder, the AFR of the cylinder may be determined based on equation 6 above as follows:

$$AFR_cylinder_map900=(Pf_plot916*k1+Pf_plot926*k2+Pf_plot936*k3)/(k1+k2+k3)$$

Thus, by using multiple modulations of AFR, calculating the peak function for each cylinder over the plurality of modulations, and using a weighted average method to calculate the cylinder AFR, a more accurate cylinder AFR may be computed. As such, deviations in measured crank accelerations during the air/fuel imbalance monitoring that occur due to minor torque disturbances may be mitigated.

An additional disturbance that may occur during air/fuel imbalance monitoring may be a canister purge operation in the engine. For example, stored fuel vapors in a canister of the evaporative emissions system may be purged into the engine. The air/fuel imbalance monitor described herein may correct for purge operation and corresponding fuel vapors received in the intake manifold.

Routine 1000 of FIG. 10 illustrates an example adjustment of the air/fuel imbalance monitor based on detecting a purge operation. Specifically, the air/fuel imbalance monitor is suspended temporarily as the canister purge valve is opened and purge flow is ramped up. Upon a steady flow of purge vapors being achieved, the air/fuel imbalance monitor is re-activated. Routine 1000 is described with reference to FIG. 1 as well as previously described routines. Instructions for carrying out routine 1000 included herein may be executed by a controller, such as controller 12 of FIG. 1, based on instructions stored on a memory of the controller and in conjunction with signals received from sensors of the engine system, such as the sensors described above with reference to FIG. 1. The controller may employ engine actuators of the engine system, such as the actuators of FIG. 1 to adjust engine operation and vehicle operation, according to the routines described below.

At 1002, routine 1000 determines if the cylinder air/fuel imbalance monitor is active in the engine. For example, the controller may confirm if air/fuel ratio modulations are being introduced into each cylinder to produce a series of rich, lean, and stoichiometric conditions. If no, routine 1000 proceeds to 1004 to maintain existing engine operation and existing monitor as well as system status. Routine 1000 then ends.

However, if it is confirmed that the air/fuel imbalance monitor is operating, routine 1000 continues to 1006 to continue learning air/fuel ratios of each cylinder of the engine. As described earlier, learning air/fuel ratios of each cylinder of the engine includes, at 1008 modulating air/fuel ratio in each cylinder to produce a series of rich, lean, and stoichiometric conditions in the cylinders. As such, at 1010 the air/fuel ratio is modulated by adjusting fuel injection in the cylinders based on pre-determined patterns, such as the example depicted in table 350. The pre-determined patterns include values of fuel mass multipliers that enable an adjustment to an amount of fuel injected into each cylinder.

Next, at 1012 routine 1000 determines if canister purging is desired or indicated. For example, canister purging may be indicated when a load of the canister (that is, an amount of fuel vapors stored in the canister) is higher than a threshold load. In another example, canister purging may be desired when a threshold duration since a previous canister purge is surpassed. As such, canister purge may be performed after an emissions catalyst has achieved light-off temperature and when the engine is combusting.

If it is determined at 1012 that canister purging is not indicated, routine 1000 proceeds to 1014 to maintain the air/fuel imbalance monitor. As such, monitoring the engine for cylinder air/fuel imbalance may be continued. Routine 1000 then ends. On the other hand, if it is confirmed that a canister purge operation is desired or indicated, routine 1000 progresses to 1016 to abort the imbalance monitor. As such, the modulation of air/fuel ratios in the cylinders of the engine may be terminated at 1018, as the canister purge will provide additional fuel vapors into the engine, which may affect the pre-determined patterns of AFR modulation. Further, measuring associated crank accelerations, and learning of peak functions may also be ended.

Once the air/fuel imbalance monitor is ceased, routine 1000 continues to 1020 to begin the canister purging operation. Specifically, at 1022 the canister purge valve (CPV) in a purge line is opened. Further, the opening of the CPV may be ramped up or increased gradually. Herein, the controller communicates a signal to an electromechanical actuator, such as the CPV solenoid, to increase an opening of the CPV. As such, the controller determines a duty cycle of the CPV solenoid. Simultaneously, at 1024 a canister vent valve (CVV) in a vent line to the canister is opened from close (or maintained open, if already open). By opening the CVV, fresh air may be drawn into the canister via the vent line to promote desorption of stored fuel vapors in the canister. Further, if a fuel tank isolation valve (FTIV) is present, the FTIV is adjusted to close from open. By closing the FTIV, flow of fuel vapors from a fuel tank into the canister may be blocked. As such, the fuel tank may be isolated.

As the CPV is opened (or an opening of the CPV is increased), fuel vapors from the canister may flow therethrough along the purge line into the intake manifold. Since the CPV is ramped open gradually, the flow of purge vapors may be unsteady initially. Accordingly, at 1026 routine 1000 determines if a steady purge flow is achieved. A steady purge flow may be learned, in one example, based on a control signal received by the CPV solenoid from the controller. For example, steady purge flow may be determined based on the duty cycle of the CPV solenoid. In another example, steady purge flow may be confirmed by output from a sensor in an intake manifold. If steady purge flow is not confirmed, routine 1000 continues to 1028 to maintain the AFR imbalance monitor at disabled. Routine 1000 then returns to 1026.

Conversely, if steady purge flow rate is confirmed, routine 1000 proceeds to 1030 to re-activate the air/fuel imbalance monitor. As such, at 1030 the purge flow may be stabilized and providing a steady amount of fuel vapors from the canister into the intake manifold. However, since additional fuel vapors are received from the canister into the engine, the air/fuel imbalance monitor may be corrected for the additional fuel. Specifically, fuel mass multipliers in the patterns of table 350 may be compensated for the additional purge vapors based on the stable purge flow rate. Thus, at 1032 fuel injection into the cylinders is adjusted based on the steady purge flow rate. Said another way, fuel injection into the cylinders during AFR modulation for the imbalance monitor may be modified based on an estimated amount of fuel vapors received via the purge line from the canister. As such, the amount of fuel vapors in the purge flow may be learned from the purge flow rate.

Further, at 1034, the AFR in the cylinders may be modulated to induce the series of rich, lean, and stoichiometric conditions again. However, the modulation patterns during the air/fuel imbalance monitoring (such as those in table 350) may be compensated for an amount of fuel vapors received from the canister. In one example, the fuel injected into the cylinders via fuel injectors may be reduced (from the original patterns in table 350) when purge vapors from the canister are received into the engine. Thus, the air/fuel ratio of the cylinders may be modulated to learn cylinder imbalance during steady flow purge operation in a distinct manner from when purge is not present.

Next, at 1036, routine 1000 includes maintaining the purge flow at the steady flow rate until the air/fuel ratio imbalance monitoring is completed. Routine 1000 then ends. It will be noted that once the purge operation is terminated, the air/fuel imbalance monitor may be operated with the modulations of table 350 without any correction for purge.

Thus, air/fuel ratio imbalance monitoring may be temporarily suspended if a purge operation is indicated. Further, once the purge flow rate is stabilized, the air/fuel imbalance monitor may be restarted but with different fuel modulations to generate the desired rich, lean, and stoichiometric conditions in the cylinders. Furthermore, the purge flow may be held at the steady rate through the re-activated air/fuel imbalance monitoring. As such, when a purge operation is not occurring, AFR in the cylinders may be modulated during imbalance monitoring via a first fuel injection amount whereas when the purge operation is ongoing with steady purge flow, AFR may be modulated in the imbalance monitor via a second fuel injection amount. It will be noted that the first fuel injection amount may be based on pre-determined patterns such as those depicted and described in reference to FIG. 3 (table 350). However, the second fuel injection amount may be based on the steady purge flow rate. Specifically, the second fuel injection amount may be the pre-determined patterns of table 350 corrected for the steady flow of purge vapors from the canister.

In this way, an engine may be monitored for cylinder air/fuel ratio (AFR) imbalance. By using a plurality of modulations of air/fuel ratio that induce rich, lean, and stoichiometric conditions in the cylinder, a peak function indicative of cylinder AFR may be learned. The peak function may be computed based on a matching of measured crank accelerations and pre-determined crank accelerations. To enhance accuracy of the results, the peak function may be learned over multiple repetitions of AFR modulation wherein at least one modulation of AFR is excluded. The estimated cylinder AFR may be more reliable as the estimated cylinder AFR is based on a weighted average of the multiple peak functions learned over numerous repetitions. Further, the cylinder with AFR imbalance may be determined based on an outlier calculation, which in turn is based on estimating a weighted average of AFRs of all cylinders in the engine. Overall, the technical effect of ascertaining cylinder AFR with a higher degree of accuracy is enabling adjustments to engine operation based on detected AFR imbalance. Accordingly, engine performance may be enhanced and emissions may be reduced.

In one example, a method may comprise modulating an air/fuel ratio in a cylinder of an engine to generate a series of rich, lean, and stoichiometric conditions, and identifying potential air/fuel imbalance in the cylinder based on a peak function, the peak function determined over a plurality of modulations of the air/fuel ratio, wherein the peak function is computed as a reciprocal of a sum of squares of crank accelerations over the plurality of modulations. In the preceding example, the peak function may additionally or optionally indicate a deviation of the air/fuel ratio of the cylinder from a predetermined air/fuel ratio. In any or all of the preceding examples, the method may additionally or alternatively comprise excluding one of the plurality of modulations during consecutive repetitions of the series of rich, lean, and stoichiometric conditions. In any or all of the preceding examples, the sum of squares of crank accelerations may additionally or optionally include a difference between a pre-determined crank acceleration and a measured crank acceleration at each of the plurality of modulations added to a difference between an average pre-determined crank acceleration and an average of measured crank acceleration during the plurality of modulations. In any or all of the preceding examples, the method may additionally or optionally comprise determining a magnitude of each peak function over each of the plurality of modulations. In any or all of the preceding examples, the air/fuel ratio of the cylinder may be additionally or optionally estimated by calculating a weighted average of the air/fuel ratio, the weighted average based on the magnitude of each peak function during the plurality of modulations. In any or all of the preceding examples, the method may additionally or optionally comprise determining an air/fuel ratio for each cylinder of the engine, and indicating air/fuel imbalance in a given cylinder by comparing the air/fuel ratio of each cylinder with a weighted average of air/fuel ratio of all cylinders of the engine. In any or all of the preceding examples, the method may additionally or optionally comprise normalizing the crank accelerations for spark timing during each of the plurality of modulations.

In another example, a method for an engine may comprise modulating an air/fuel ratio in a cylinder to produce a series of lean, rich, and stoichiometric conditions of the cylinder, identifying a potential air/fuel imbalance in the cylinder based on crank accelerations generated during the modulating, and responsive to a purge operation in the engine, disabling the modulating and ceasing the identifying of the potential air/fuel imbalance. In the preceding example, the method may additionally or optionally comprise resuming the identifying of potential air/fuel imbalance in the cylinder responsive to a steady purge flow rate. In any or all of the preceding examples, prior to the purge operation the modulating of air/fuel ratio in the cylinder may additionally or optionally include applying a first adjustment to a fuel amount injected into the cylinder, and wherein modulating the air/fuel ratio to identify potential air/fuel imbalance in the cylinder during the purge operation with steady purge flow rate may additionally or optionally include applying a second adjustment to the fuel amount in the cylinder. In any or all of the preceding examples, the first adjustment amount may additionally or optionally be based on a pre-determined pattern, and the second adjustment may additionally or optionally be based on the steady purge flow rate. In any or all of the preceding examples, identifying the potential air/fuel imbalance in the cylinder may additionally or optionally include computing a peak function based on a sum of squares of crank accelerations during each of a plurality of modulations of the air/fuel ratio, and wherein at least one modulation of air-fuel ratio may additionally or optionally be excluded during consecutive repetitions of the plurality of modulations.

An example system may comprise an engine with a first cylinder and a second cylinder, a crankshaft sensor, a first fuel injector coupled to the first cylinder and a second fuel injector coupled to the second cylinder, and a controller configured with instructions stored in non-transitory memory and executable by a processor for modulating air/fuel ratio of the first cylinder in a series of rich, lean, and stoichiometric conditions by varying fuel injected by the first fuel injector, modulating air/fuel ratio of the second cylinder in a series of lean, rich, and stoichiometric conditions by varying fuel injected by the second fuel injector, measuring crank accelerations via the crankshaft sensor generated by the modulating, learning a first air/fuel ratio of the first cylinder and learning a second air/fuel ratio of the second cylinder based on the crank accelerations, computing a weighted average of air/fuel ratio based on learned air/fuel ratios for each of the first cylinder and second cylinder, and indicating degradation of the first cylinder responsive to a deviation of the first air/fuel ratio from the weighted average being higher than a threshold deviation. In the preceding example, the engine may additionally or optionally be maintained at stoichiometric air/fuel ratio during the modulating, and the controller includes further instructions for not indicating degradation of the second cylinder responsive to a deviation of the second air/fuel ratio from the weighted average being lower than the threshold deviation. In any or all of the preceding examples, the controller may additionally or optionally include further instructions for adjusting one or more engine operating parameters in response to indicating degradation of the first cylinder. In any or all of the preceding example, the first air/fuel ratio and second air/fuel ratio may each be additionally or optionally learned based on a peak function, the peak function calculated as a reciprocal of a sum of squares of measured crank accelerations during each modulating, the sum of squares including calculating a difference between a measured crank acceleration and a corresponding pre-determined acceleration for each cylinder in each modulating, and a difference between an average of measured crank accelerations and an average of pre-determined crank accelerations over a plurality of modulations. In any or all of the preceding examples, the system may additionally or optionally further comprise a first spark plug coupled to the first cylinder and a second spark plug coupled to the second cylinder, and wherein the measured crank accelerations for each cylinder may additionally or optionally be adjusted for spark timing. In any or all of the preceding examples, the system may additionally or optionally further comprise a canister fluidically coupled to an intake manifold of the engine, and wherein the controller may additionally or optionally include further instructions for ceasing the modulating of air/fuel ratio in each of the first cylinder and the second cylinder in response to a purging operation of the canister. In any or all of the preceding examples, the controller may additionally or optionally include further instructions for responsive to a steady purge flow rate, estimating an amount of purge vapors and restarting the modulating of air/fuel ratio in each of the first cylinder and the second cylinder, and wherein the controller may additionally or optionally include further instructions for adjusting an amount of fuel injected in each of the first cylinder and the second cylinder based on the estimated amount of purge vapors received in the intake manifold.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

an engine with a first cylinder and a second cylinder;

a crankshaft sensor;

a first fuel injector coupled to the first cylinder and a second fuel injector coupled to the second cylinder; and a controller configured with instructions stored in non-transitory memory and executable by a processor for:

modulating air/fuel ratio of the first cylinder in a series of rich, lean, and stoichiometric conditions by varying fuel injected by the first fuel injector;

modulating air/fuel ratio of the second cylinder in a series of lean, rich, and stoichiometric conditions by varying fuel injected by the second fuel injector;

measuring crank accelerations via the crankshaft sensor generated by the modulating;

learning a first air/fuel ratio of the first cylinder and learning a second air/fuel ratio of the second cylinder based on the crank accelerations;

computing a weighted average of air/fuel ratio based on learned air/fuel ratios for each of the first cylinder and second cylinder; and indicating degradation of the first cylinder responsive to a deviation of the first air/fuel ratio from the weighted average being higher than a threshold deviation.

2. The system of claim 1, wherein the engine is maintained at stoichiometric air/fuel ratio during the modulating, and the controller includes further instructions for not indicating degradation of the second cylinder responsive to a deviation of the second air/fuel ratio from the weighted average being lower than the threshold deviation.

3. The system of claim 1, wherein the controller includes further instructions for adjusting one or more engine operating parameters in response to indicating degradation of the first cylinder.

4. The system of claim 1, wherein the first air/fuel ratio and second air/fuel ratio are each learned based on a peak function, the peak function calculated as a reciprocal of a sum of squares of measured crank accelerations during each modulating, the sum of squares including calculating a difference between a measured crank acceleration and a corresponding pre-determined acceleration for each cylinder in each modulating, and a difference between an average of measured crank accelerations and an average of pre-determined crank accelerations over a plurality of modulations.

5. The system of claim 1, further comprising a first spark plug coupled to the first cylinder and a second spark plug coupled to the second cylinder, and wherein the measured crank accelerations for each cylinder are adjusted for spark timing.

6. The system of claim 1, further comprising a canister fluidically coupled to an intake manifold of the engine, and wherein the controller includes further instructions for ceasing the modulating of air/fuel ratio in each of the first cylinder and the second cylinder in response to a purging operation of the canister.

7. The system of claim 6, wherein the controller includes further instructions for responsive to a steady purge flow rate, estimating an amount of purge vapors and restarting the modulating of air/fuel ratio in each of the first cylinder and the second cylinder, and wherein the controller includes further instructions for adjusting an amount of fuel injected in each of the first cylinder and the second cylinder based on the estimated amount of purge vapors received in the intake manifold.

8. A method for an engine, comprising:

modulating an air/fuel ratio in a cylinder to produce a series of lean, rich, and stoichiometric conditions of the cylinder;

identifying a potential air/fuel imbalance in the cylinder based on crank accelerations generated during the modulating; and responsive to a purge operation in the engine, disabling the modulating and ceasing the identifying of the potential air/fuel imbalance.

9. The method of claim 8, further comprising, resuming the identifying of potential air/fuel imbalance in the cylinder responsive to a steady purge flow rate.

10. The method of claim 9, wherein prior to the purge operation the modulating of air/fuel ratio in the cylinder includes applying a first adjustment to a fuel amount injected into the cylinder, and wherein modulating the air/fuel ratio to identify potential air/fuel imbalance in the cylinder during the purge operation with steady purge flow rate includes applying a second adjustment to the fuel amount in the cylinder.

11. The method of claim 10, wherein the first adjustment amount is based on a pre-determined pattern, and the second adjustment is based on the steady purge flow rate.

12. The method of claim 8, wherein identifying the potential air/fuel imbalance in the cylinder includes computing a peak function based on a sum of squares of crank accelerations during each of a plurality of modulations of the air/fuel ratio, and wherein at least one modulation of air-fuel ratio is excluded during consecutive repetitions of the plurality of modulations.

13. A method, comprising:

modulating an air/fuel ratio in a cylinder of an engine to generate a series of rich, lean, and stoichiometric conditions; and identifying potential air/fuel imbalance in the cylinder based on a peak function, the peak function determined over a plurality of modulations of the air/fuel ratio, wherein the peak function is computed as a reciprocal of a sum of squares of crank accelerations over the plurality of modulations.

14. The method of claim 1, wherein the peak function indicates a deviation of the air/fuel ratio of the cylinder from a predetermined air/fuel ratio.

15. The method of claim 1, further comprising excluding one of the plurality of modulations during consecutive repetitions of the series of rich, lean, and stoichiometric conditions.

16. The method of claim 1, wherein the sum of squares of crank accelerations includes a difference between a pre-determined crank acceleration and a measured crank acceleration at each of the plurality of modulations added to a difference between an average pre-determined crank acceleration and an average of measured crank acceleration during the plurality of modulations.

17. The method of claim 1, further comprising determining a magnitude of each peak function over each of the plurality of modulations.

18. The method of claim 17, wherein the air/fuel ratio of the cylinder is estimated by calculating a weighted average of the air/fuel ratio, the weighted average based on the magnitude of each peak function during the plurality of modulations.

19. The method of claim 18, further comprising determining an air/fuel ratio for each cylinder of the engine, and indicating air/fuel imbalance in a given cylinder by comparing the air/fuel ratio of each cylinder with a weighted average of air/fuel ratio of all cylinders of the engine.

20. The method of claim 1, further comprising normalizing the crank accelerations for spark timing during each of the plurality of modulations.

* * * * *